United States Patent [19]

McKnight

[11] 3,994,605

[45] Nov. 30, 1976

[54] POCKET PEN

[76] Inventor: John R. McKnight, 5087 Park West Ave., San Diego, Calif. 92117

[22] Filed: Feb. 23, 1976

[21] Appl. No.: 660,445

[52] U.S. Cl. ..... 401/99; 401/6

[51] Int. Cl.[2] ..... B43K 7/12; B43K 24/02

[58] Field of Search ..... 401/6–8, 401/59–60, 99–114

[56] References Cited

UNITED STATES PATENTS

| | | | |
|---|---|---|---|
| 2,064,555 | 12/1936 | Mitchell | 401/59 |
| 2,259,649 | 10/1941 | Maucher | 401/99 |
| 3,801,700 | 5/1974 | Bryan | 401/59 |

*Primary Examiner*—Lawrence Charles
*Attorney, Agent, or Firm*—Ralph S. Branscomb

[57] ABSTRACT

The invention is a ballpoint pen characterized by a generally teardrop-shaped planar casing defining an arcuate channel therein to receive a conventional, flexible ink cartridge in a compact configuration, this casing having a key-chain hole therein and a retractor button disposed on one side or edge thereof.

8 Claims, 11 Drawing Figures

POCKET PEN

BACKGROUND OF THE INVENTION

The invention is in the field of ballpoint pens.

Conventional ballpoint pens are long and narrow, following the tradition of fountain pens, pencils, and writing plumes. This shape is generally comfortable to write with but is also bulky and at times difficult to carry around, for example when the user is not wearing a shirt with a pocket and must resort to carrying the pen in his pants pocket, which is uncomfortable and risks puncturing of the pocket lining by the pen. However, inasmuch as virtually all presently manufactured ballpoint pens are constructed in this elongated shape, and the ink cartridges are made to fit within this shape, no ballpoint pen has been designed which takes advantage of the entire length of conventional ink cartridges and yet is retractable and easily portable in a pants pocket or a purse.

SUMMARY OF THE INVENTION

The present invention provides a ballpoint pen having a flat casing which is short compared to a conventional pen but utilizes the entire length of a flexible, conventional ink cartridge by storing same in an arcuate channel for the sake of compactness as well as to provide a pair of broad, flat surfaces which could be imprinted with advertising material, or the emblem of a University or the like, or other indicia which due to its two dimensional scope would not readily fit on the side of a conventional ballpoint pen. It is intended that the pen be used as a holder for a keychain and to this end it is provided with a chain hole, and a retractor button connects to a spring-loaded detent which will securely fix the cartridge in its projected or withdrawn mode.

DETAILED DESCRIPTION OF THE PREFERRED EMBODIMENT

Figure 1:
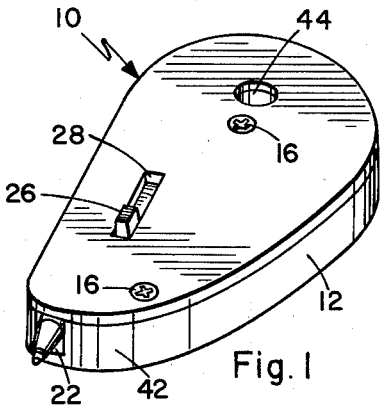
FIG. 1 is a perspective view of the pen.

As best seen in FIG. 1, the pen is generally planar as opposed to the conventional cylindrical construction and in planform somewhat resembles a teardrop, although this is subject to variation. The casing 10 of the pen is comprised of a body portion 12 which defines the channels and corridors of the casing which house the pen mechanism, and a cover plate 14 which is secured by screws 16 or other suitable means to the body portion.

It would also be possible and perhaps preferable to form the other side of the casing as the cover plate and the plate side as the body, or split the casing evenly down the center.

Figure 2:
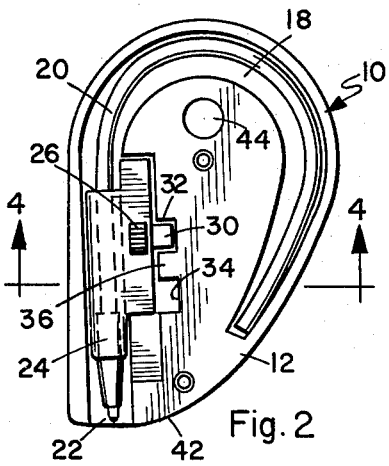
FIG. 2 is a top plan view with the cover removed and the point retracted.
Figure 3:
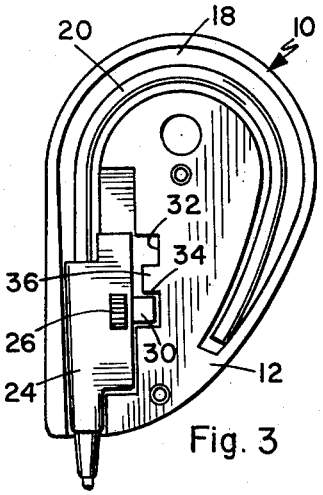
FIG. 3 is a similar view with the point extended.

As can be seen best in FIGS. 2 and 3, the body portion and cover plate together define a curved channel 18, and within this channel is disposed an arcuately bent flexible ink cartridge 20 which is significantly smaller in both the longitudinal and width dimensions than the channel. The channel extends and terminates at one end at an opening 22 through which the writing tip of the cartridge is projected, and to control the projection and retraction of the cartridge a sleeve-type gripping element 24 is used to engage the cartridge and is operable by means of a tab or button 26 which extends through a slot 28 in the casing.

It is necessary that when the cartridge is extended in writing position it is locked so it will not retract accidentally, and to this end a key 30 is incorporated on the gripping sleeve and as is best seen in FIGS. 2 and 3, this key is alternatively engageable in slots 32 and 34 which are separated by an intermediate tab 36. A spring means of one sort or another is utilized to urge the key upward toward the cover plate so that it can be seen that upon depressing the tab 36 the gripping sleeve is free to slide backwards and forwards beneath the tab 36, and upon releasing the button 26 in its rearmost or forwardmost position as shown in FIGS. 2 and 3, respectively, the key will engage the slot 32, such that the pen is in its retracted position, or the slot 34 in which position the tab 36 holds the key forward to permit writing with the pen. If the tab is tapered as shown, the cartridge will slide freely into the projected position and lock there without the necessity of depressing the button 26, which would, of course, have to be depressed to retract the cartridge.

Figure 4:
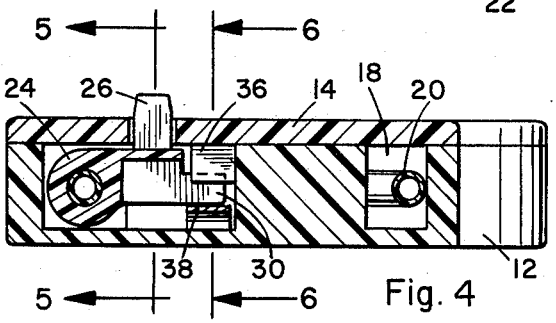
FIG. 4 is an enlarged sectional view taken on line 4—4 of FIG. 2.
Figure 5:
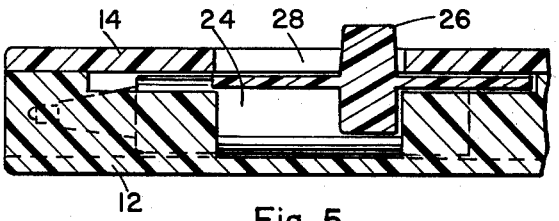
FIG. 5 is a sectional view taken on line 5—5 of FIG. 4.
Figure 6:
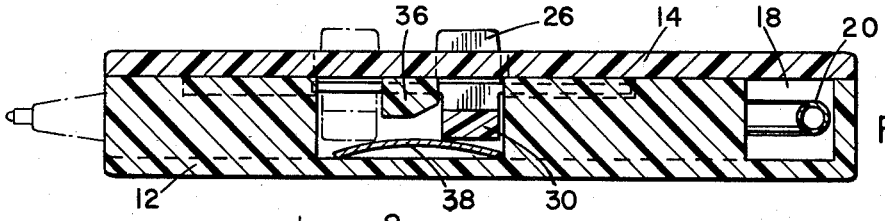
FIG. 6 is a sectional view taken on line 6—6 of FIG. 4.
Figure 7:
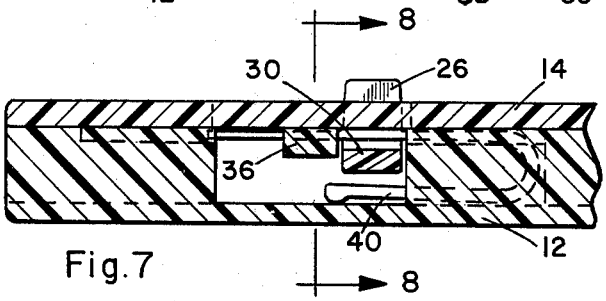
FIG. 7 is a sectional view similar to FIG. 6, showing an alternative spring arrangement.
Figure 8:
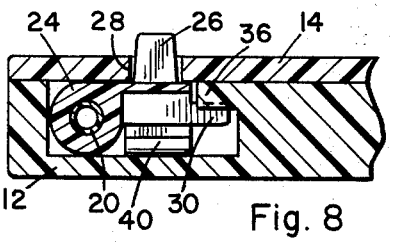
FIG. 8 is a sectional view taken on line 8—8 of FIG. 7.

Two different types of springs are indicated, the first being a short metallic leaf spring 38 indicated in FIGS. 4 and 6, and in FIGS. 7 and 8, an extension 40 is shown comprised of resilient plastic or other material which represents a doubled-back portion of the cartridge gripping sleeve.

Figure 9:
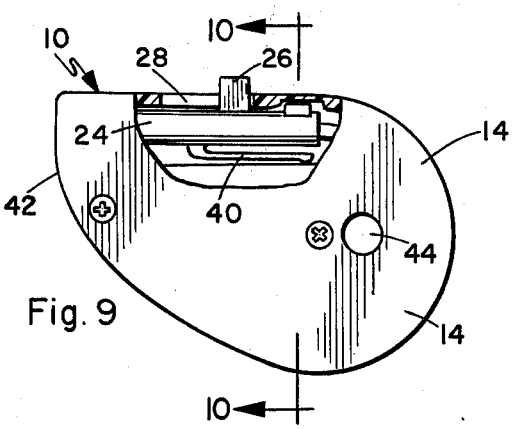
FIG. 9 is a top plan view, partially cut away, with the actuating button in the side of the pen.
Figure 10:
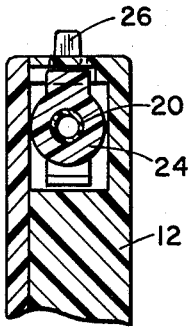
FIG. 10 is an enlarged sectional view taken on line 10—10 of FIG. 9.

In a further embodiment of the operating mechanism of the pen shown in FIGS. 9 and 10, the button 26 projects from the edge of the pen casing rather than through the cover plate 14 and a resilient extension 40 is utilized as in FIGS. 7 and 8 for the biasing. A key 30 is used in nearly identical fashion to the other embodiments.

Figure 11:
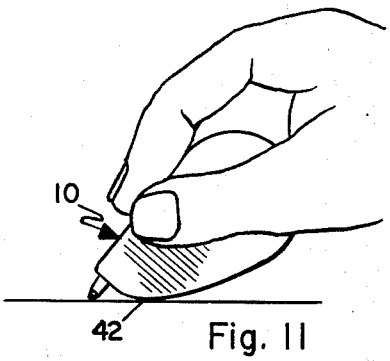
FIG. 11 illustrates the pen in use.

In addition to the advantage provided by the pen when carried in a pocket or a purse, because of the curved lobe 42 adjacent the tip of the cartridge, support is provided by the writing surface very close to the tip of the pen as shown in FIG. 11. This is a very desirable feature for those with arthritis or other motor nerve control ailments wherein writing is difficult if not impossible absent support provided to the pen tip other than from the hand.

A hole 44 is provided in a portion of the casing, preferably inside the channel. This hole would ordinarily be used to accommodate a key chain, but could also be made large enough to accommodate a ring of a loose-leaf binder to appeal to students.

In the operation of the pen, the cartridge 20 may move both longitudinally and laterally in the channel 18 as opposed to undergoing a strictly longitudinal movement. This can be visualized from comparing FIGS. 2 and 3, and is a definite advantage insofar as the friction of sliding the cartridge along the channel is eliminated. However, as an obvious variation the channel could be narrowed to permit sliding movement only, or on the other hand it could be widened considerably, perhaps in the form of a considerable expansion of the keychain opening 44 so that the entire pen would resemble a ring. However, it is believed to be advantageous to preserve the flat, parallel sides of the casing so that school emblems or other advertising or logos may be effectively displayed by the pen so that it may be successful as a give-away item. By utilizing the curved flexible cartridge, the same quantity of ink may be provided in a pen which is easily carried in the hip pocket or purse as is ordinarily available in a cylindrical pen which is difficult to carry other than in shirt or coat pockets.

I claim:

1. A pocket pen comprising:

a. a casing;

b. said casing defining a curved channel and having an opening at one end of said channel;

c. an elongated flexible ink cartridge disposed in said channel;

d. retractor means mounted in said casing and being accessible from outside said casing for selectively and releasably securing said cartridge alternatively in projected or retracted position.

2. Structure according to claim 1 wherein said channel is generally U-shaped and larger in cross section then said cartridge such that as said cartridge is sequentially projected and retracted at least a portion thereof is free to move laterally in said channel as well as longitudinally therein.

3. Structure according to claim 1 wherein said casing is generally planar and defines two parallel sides, and is provided with an opening to accommodate a key chain.

4. Structure according to claim 1 wherein said retractor means comprises a cartridge-gripping sleeve having a tab extending through said casing and including a key mounted on said sleeve, said casing defining two slots and said key being selectively seatable in one of said two slots such that the projected and retracted positions of said cartridge are defined.

5. Structure according to claim 4 and including means biasing said key into engagement with said slots.

6. Structure according to claim 5 wherein said bias means comprises a resilient spring arm extending from said sleeve and biased against a wall of said casing.

7. Structure according to claim 1 wherein said casing defines a lobe adjacent the writing tip of said pen such that said lobe and the writing tip can be made to simultaneously contact a writing surface to steady the pen in use.

8. Structure according to claim 1 wherein said casing is essentially teardrop-shaped in planform, and said cartridge projects through the narrower end thereof, and said casing is provided with a lobe adjacent the point of projection of said cartridge to permit the steadying of said pen on a writing surface.

* * * * *